US005683285A

United States Patent [19]

Wong

[11] Patent Number: 5,683,285

[45] Date of Patent: Nov. 4, 1997

[54] TOYS

[75] Inventor: Tak-Ko Wong, Hong Kong, Hong Kong

[73] Assignee: T. K. Wong & Associates, Ltd., Hong Kong, Hong Kong

[21] Appl. No.: 719,719

[22] Filed: Sep. 25, 1996

[30] Foreign Application Priority Data

Dec. 6, 1995 [GB] United Kingdom ..... 9525250

[51] Int. Cl.[6] ..... A63H 15/00

[52] U.S. Cl. ..... 446/289; 446/324; 446/431; 446/437

[58] Field of Search ..... 446/138, 139, 446/316, 324, 377, 390, 431, 437, 289

[56] References Cited

U.S. PATENT DOCUMENTS

| | | | |
|---|---|---|---|
| 1,849,533 | 3/1932 | Parton | 446/289 |
| 3,638,354 | 2/1972 | Morrison | 446/324 |
| 4,764,148 | 8/1988 | Wong | 446/289 |
| 4,884,989 | 12/1989 | Wong | 446/324 |

FOREIGN PATENT DOCUMENTS

| | | | |
|---|---|---|---|
| 55-078982 | 6/1980 | Japan | 446/431 |
| 478022 | 6/1938 | United Kingdom | 446/377 |

*Primary Examiner*—Robert A. Hafer
*Assistant Examiner*—Jeffrey D. Carlson
*Attorney, Agent, or Firm*—Gunn, Lee & Miller, P.C.

[57] ABSTRACT

A toy beetle which travels down a vertical surface under the influence of gravity has four movable limbs which are arranged in pairs at opposite ends of an axle that is rotatable about a transverse axis of the beetle. Sticky materials at the ends of the limb adhere temporarily to the vertical surface in use. According to the orientation of the beetle with respect to the vertical the beetle will either, in somewhat random fashion, walk or tumble down the surface.

6 Claims, 2 Drawing Sheets

TOYS

BACKGROUND OF THE INVENTION

1. Field of the Invention

The invention relates to toys.

2. Description of Prior Art

The invention relates more especially to so-called "wall-walkers" that move down an inclined plane, including a vertical surface, under the action of gravity. An example of such a toy is found in UK patent specification No. 2222958. The toys have sticky limbs that temporarily hold the ends of limbs against a supporting surface.

SUMMARY OF THE INVENTION

According to the invention there is provided a toy which under the influence of gravity will travel down a substantively vertical surface, the toy having a central body with a longitudinal axis and an axle supported generally at right angles to the longitudinal axis with a pair of limbs supported by each respective end of the axle to describe circles in respective planes generally parallel to the longitudinal axis one at each side of the body, in which each limb has a region of sticky material adjacent its extremity, the sticky material temporarily sticking in use to the vertical surface to support the toy during movement of the toy down the surface, in which (taking a view along the rotational axis of the axle) one pair of limbs extends from the axis with a limb in a direction at about 0° and at about 180° and the other pair of limbs extends with a limb in a direction at about 90° and at about 270° so that in one mode the toy tumbles around its longitudinal axis down the surface and in another mode the toy walks in the direction of its longitudinal axis.

The axle may comprise two pieces joined centrally by a flexible coupling that permits the two axle pieces to rotate about two axes that are somewhat off-set from one another.

The axle or axles may be provided with one or more cranks.

The axle or axles may be supported in the body by a single bearing.

The part axle and one pair of limbs may be formed of integrally moulded identical pieces provided with central couplings that fit together to support two pieces in the correct orientation to form a complete axle with a pair of limbs at each end.

The extremities of the pairs of limbs may each be formed with eyelets and the sticky material is pre-formed separately as inserts which fit to and through the eyelets to become secured thereto.

BRIEF DESCRIPTION OF THE DRAWINGS

A toy according to the invention will now be described by way of example with reference to the accompanying drawings in which.

DESCRIPTION OF THE PREFERRED EMBODIMENTS

Figure 1:
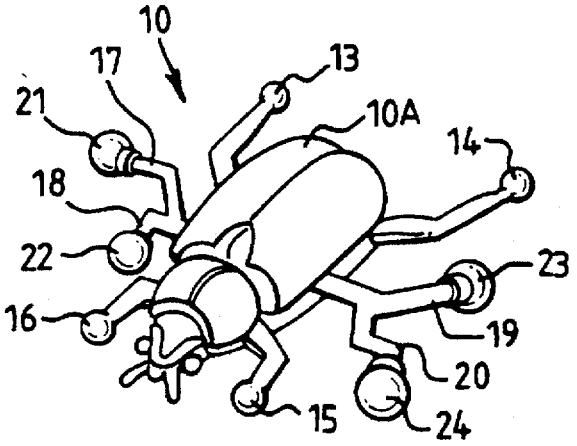
FIG. 1 shows an isometric view of the toy in the form of a beetle.
Figure 2:
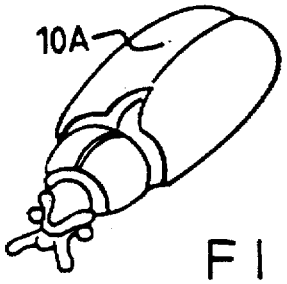
FIG. 2 shows an isometric view of a top of the beetle.
Figure 3:
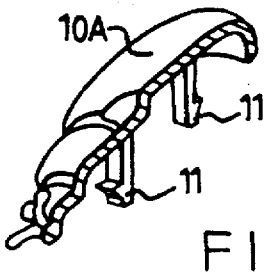
FIG. 3 shows an isometric sectional view of the top of the beetle.
Figure 4:
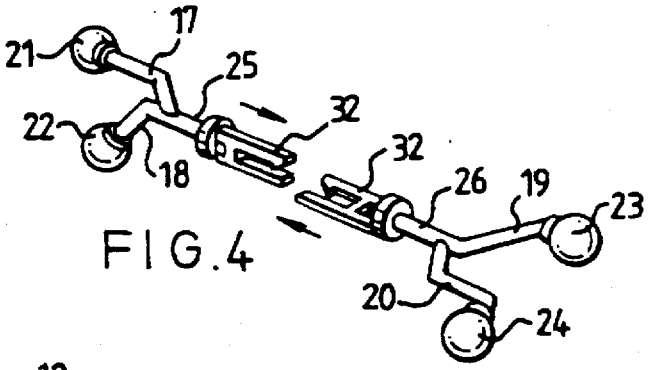
FIG. 4 shows isometric exploded view of movable limbs of the beetle.
Figure 5:
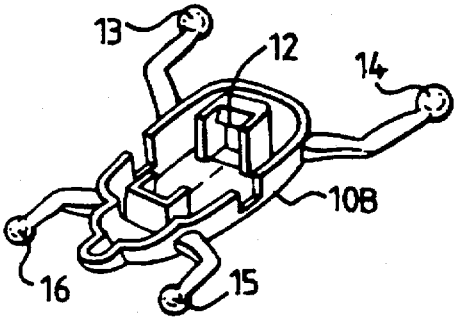
FIG. 5 shows an isometric view of a bottom of the beetle.
Figure 6:
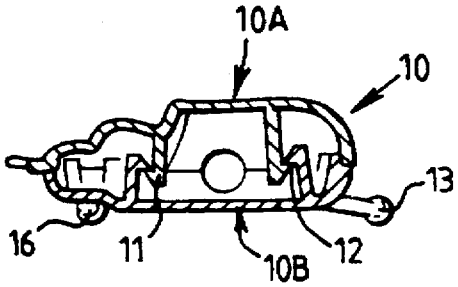
FIG. 6 shows a side sectional view of the beetle.

Referring to the drawings, FIGS. 1 to 6 show a beetle having a body 10 formed of a plastic moulded top 10A and a bottom 10B which snap together when pressed towards one another by integrally formed clips 11 fitting under ledges 12, as best seen in FIG. 6. The beetle has four fixed limbs 13, 14, 15 and 16 and four movable limbs 17, 18, 19 and 20. The movable limbs are arranged in pairs that are formed with respective regions of sticky material 21, 22, 23 and 24 adjacent their extremities.

Each pair of limbs is supported on respective "half" axles 25 and 26 that are constrained to rotate about an axis generally at right angles to a longitudinal axis of the body 10 and such that the sticky material regions 21 to 24 describe circles in planes which are generally parallel to the longitudinal axis. It will be noted that, taking a view along the common rotational axis of the axles in FIG. 4, the sticky material regions are arranged to describe circles when the axles rotate with regions 21 and 22 positioned relatively at, say, 0° and 180° and regions 23 and 24 positioned at 90° and 270° respectively. Such relative angular dispositions need not be precise in practice, that is some variations of a few degrees are permissible, for satisfactory performance of the beetle in use.

What happens in any event is that when the beetle is placed on a vertical, or at least steeply inclined surface, two of the sticky material regions will come into contact with the surface. The sticky material regions temporarily adhere to the surface, in a similar manner known for example and described in UK patent No. 2222958, until the influence of gravity overcomes the stiction to release one or both the sticky regions from the surface. At this time the beetle moves down the surface. In accordance with embodiments of present invention, the actual movement of beetle is to some extent random although it depends on the orientation of the beetle. If the longitudinal axis of the body 10 of the beetle is vertical, the beetle will "walk" down the surface in a generally straight line. If the longitudinal axis of the body 10 is horizontal, the beetle will "tumble" down the surface, rolling around the longitudinal axis. For other orientations, especially where the longitudinal axis is about 45° to the vertical, the beetle may "walk" or may "tumble" providing a unique and interesting performance for the toy. It will be appreciated that because the configuration and the relative movement of its limbs is not precise and because the stiction and the imperfections in the surface cannot be wholly predicted, the beetle will not normally "walk" or "tumble" in a totally predictable way, even if it starts with its longitudinal axis vertical or horizontal. This means that the movement of the beetle down the surface tends to be generally unpredictable, combining a mixture of walking and tumbling which provides excitement and fascination during play.

Figure 7:
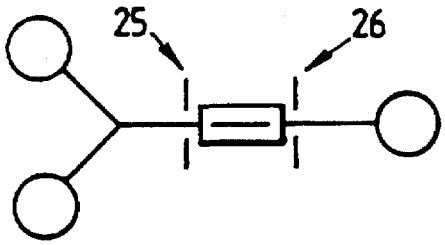
FIGS. 7 to 11 shows diagrammatically different configurations for the moving limbs of the beetle.
Figure 8:
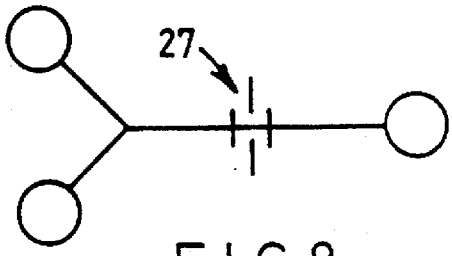
Figure 9:
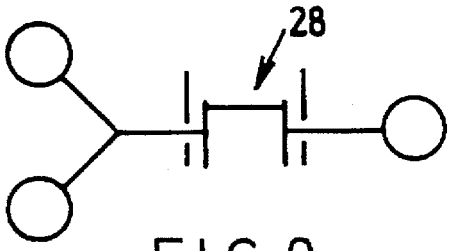
Figure 10:
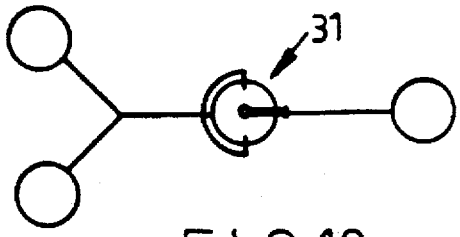
Figure 11:
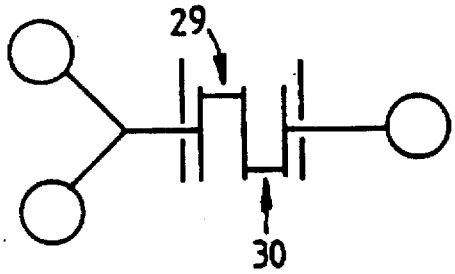

In FIGS. 7 to 11 various arrangements are shown for the axles. In FIG. 7, two axles are supported by two bearings 25 and 26, whereas in FIG. 8 there is only one bearing 27. FIG. 9 shows axles provided with one crank 28 and in FIG. 11 shows two cranks 29 and 30. Cranks in toys are known per se and can be used to operate other moving parts (not shown) such as antennae, a tail, eyes, light switches and so forth. In FIG. 10, two axles are connected by a flexible coupling 31 that allows some relative orientation between the axis of rotation of each axle. If used in the present embodiment, this introduces or allows further random forces to apply that serve or assist to make the progression of the beetle even less predictable in practice.

Referring again to FIG. 4, it will be noted that each "half" axle 25 and 26 and integrally formed limbs 17 and 18, and 19 and 20 are configured to be identical pieces. This means that in forming the pieces, usually by moulding, only one shape of mould is needed for each of the pieces. The configuration of axle couplings 32 ensures that when any two identical moulded pieces are fitted together, the limbs of each piece is in the correct relative orientation with respect to the limbs of the other piece.

Figure 12:
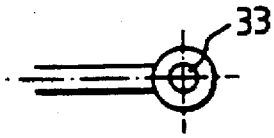
FIG. 12 shows a top view of an extremity of one of the limbs.
Figure 13:
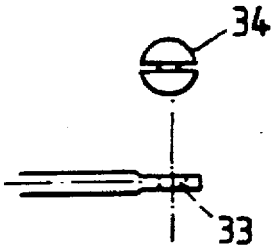
FIG. 13 shows an exploded view of a side view of FIG. 12 and a pre-formed insert of sticky material.

Before the half axles or pieces are connected together, they are placed in identical moulds and the sticky material regions 21 and 22 or 23 and 24 are moulded onto the extremities of the limbs as required. In an alternative arrangement, the extremities are provided with eyelets 33, as shown in FIG. 12, and the sticky material separately formed as inserts 34 shown in FIG. 13. During assembly the inserts 34 are pressed through the eyelets 33 to become secured to extremities of the limbs as required. This can be done conveniently before the two half axles or pieces are connected together.

The sticky material is preferably Styrene Ethylene Butylene Styrerie Triblock Copolymer (see U.S. Pat. No. 4,369,284) or Hydrogenated Styrene Isoprene/Butadiene Block Copolymer. The sticky material can be moulded with or without a tackifier to increase its stickiness so as to achieve the desired performance, especially speed of movement, which is proportional to the weight of the toy and the adhesiveness of the vertical surface.

Whereas a beetle has been described various other insects, or any other figurines generally, can be provided in accordance with the invention and in which movement down a surface during play is usually a generally random combination of walking and tumbling.

I claim:

1. A toy which under the influence of gravity will travel down a substantively vertical surface, the toy having a central body with a longitudinal axis and an axle supported generally at right angles to the longitudinal axis with a pair of limbs supported by each respective end of the axle to describe circles in respective planes generally parallel to the longitudinal axis one at each side of the body, in which each limb has a region of sticky material adjacent its extremity, the sticky material temporarily sticking in use to the vertical surface to support the toy during movement of the toy down the surface, in which (taking a view along the rotational axis of the axle) one pair of limbs extends from the axis with a limb in a direction at about 0° and at about 180° and the other pair of limbs extends with a limb in a direction at about 90° and at about 270° so that in one mode the toy tumbles around its longitudinal axis down the surface and in another mode the toy walks in the direction of its longitudinal axis.

2. A toy according to claim 1, in which the axle comprises two pieces joined centrally by a flexible coupling that permits the two axle pieces to rotate about two axes that are somewhat off-set from one another.

3. A toy according to claim 1, in which the axle or axles are provided with one or more cranks.

4. A toy according to claim 1, in which the axle or axles are supported in the body by a single bearing.

5. A toy according to claim 1, in which one part of each axle and one pair of limbs are formed of integrally moulded identical pieces provided with central couplings that fit together to support two pieces in the correct orientation to form a complete axle with a pair of limbs at each end.

6. A toy according to claim 1, in which the extremities of the pairs of limbs are each formed with eyelets and the sticky material is pre-formed separately as inserts which fit to and through the eyelets to become secured thereto.

* * * * *